US006325232B1

(12) United States Patent
Luttmann et al.

(10) Patent No.: US 6,325,232 B1
(45) Date of Patent: Dec. 4, 2001

(54) PROCESS FOR PRODUCING A FILLED CONTAINER AND FILLED CONTAINER

(75) Inventors: Jurgen Luttmann, Kirchlinteln; Rolf Hornig, Kirchlinteln/Luttum; Gebhard Kregel, Visselhovede/Ottingen; Bernd Albrecht, Kirchlinteln, all of (DE)

(73) Assignee: Effem GmbH, Verden/Aller (DE)

( * ) Notice: Subject to any disclaimer, the term of this patent is extended or adjusted under 35 U.S.C. 154(b) by 0 days.

(21) Appl. No.: 09/667,066

(22) Filed: Sep. 21, 2000

Related U.S. Application Data

(62) Division of application No. 09/233,411, filed on Jan. 19, 1999.

(30) Foreign Application Priority Data

Jul. 19, 1996 (DE) ..... 196 29 148
Mar. 3, 1997 (DE) ..... 197 08 583

(51) Int. Cl.[7] ..... B65D 41/40
(52) U.S. Cl. ..... 220/276; 220/265; 220/672
(58) Field of Search ..... 220/265, 266, 220/276, 309.1, 310.1, 619, 625, 672; 53/412

(56) References Cited

U.S. PATENT DOCUMENTS

| | | | | |
|---|---|---|---|---|
| 1,849,768 | * | 3/1932 | Punte | 220/276 |
| 1,860,201 | * | 5/1932 | Punte | 220/276 |
| 1,898,925 | | 2/1933 | Anderson | 53/412 |
| 2,488,528 | * | 11/1949 | Erb | 220/276 |
| 2,517,064 | | 8/1950 | Wales . | |
| 3,268,109 | * | 8/1966 | Coppens | 220/672 |
| 3,472,418 | * | 10/1969 | Ullman | 220/672 |
| 3,604,178 | | 9/1971 | Bluhm | 53/412 |
| 3,724,742 | | 4/1973 | Henderson | 53/412 |
| 3,883,033 | | 5/1975 | Brown | 220/266 |
| 3,930,593 | * | 1/1976 | Ragettli | 220/276 |
| 4,880,129 | | 11/1989 | McHenry et al. | 53/412 |
| 5,042,226 | | 8/1991 | Osip et al. | 53/412 |
| 5,566,529 | | 10/1996 | Sireix | 53/412 |
| 6,102,237 | * | 8/2000 | Nguyen et al. | 220/276 |

FOREIGN PATENT DOCUMENTS

| | | |
|---|---|---|
| 244486 | 9/1946 | (CH) . |
| 747325 | 4/1956 | (CH) . |
| 544 696 | 1/1974 | (CH) . |
| 2 061 497 | 6/1972 | (DE) . |
| 25 26 536 | 12/1976 | (DE) . |
| 40 23 996 | 1/1992 | (DE) . |
| 43 26 114 | 5/1996 | (DE) . |
| WO 96/07593 | 3/1996 | (WO) . |

* cited by examiner

*Primary Examiner*—Nathan J. Newhouse
(74) *Attorney, Agent, or Firm*—Dorsey & Whitney LLP

(57) ABSTRACT

A process for manufacturing a container and a container which can be readily opened without a tool wherein after sterilization of the sealed container a wall of the container is weakened to permit the top to be twisted off without the use of a tool.

8 Claims, 7 Drawing Sheets

PROCESS FOR PRODUCING A FILLED CONTAINER AND FILLED CONTAINER

This application is a division of application Ser. No. 09/233,411, filed Jan. 19, 1999 and is based on International Application No. PCT/DE97/01536, filed Jul. 18, 1997 and German Application Nos. 19629148.8, filed Jul. 19, 1996, and 19708583.0, filed Mar. 3, 1997.

BACKGROUND OF THE INVENTION

FIELD OF THE INVENTION

The invention relates to a process for producing a filled, sealed and sterilized container comprising at least one can body and at least one lid body, which can be opened without the aid of a tool, as well as to a container which can be produced according to the process.

Containers in general are packs (hereinafter use is made of the all-embracing term "container"), which can be opened without the aid of tools, such as e.g., knives, can openers, etc. These types of containers, known as easy open systems, have acquired increased importance over the last few years due to the much easier handling such containers provide for the user.

Thus, use is made to a considerable extent of ring pull lids in can-like packs in the human and animal food sector. However, in many cases, particularly when metal is used as the base material, there is a risk of sharp edges being formed following the opening of the can.

A particular problem occurs in containers where, after filling and sealing, the contents must be preserved by sterilization. In this case the internal pressure within the can resulting from the elevated sterilization temperatures must be withstood by the container. The connection between the lid body and the can body, in particular, constitutes a weak point in the case of such easy open systems.

Therefore the problem the invention overcomes is to develop a process that overcome the disadvantages of the prior art while making available an easy open system without any risk of an unintentional destruction of the filled container during the sterilization process.

SUMMARY OF THE INVENTION

According to the invention, this problem is inventively solved in that following the filling of the container with the intended contents and sterilization of the container at temperatures adequate for preserving the contents, a weakening of the material of the container at a predetermined location is provided in such a way that the container parts can be separated without the aid of a tool.

According to one embodiment, there is a weakening or severing of the container wall. Alternatively there can be a weakening or severing of the base material of the container wall.

It is also possible to provide a weakening or severing of the container wall in an area where, in the empty state, following the initial severing of the base material of the container wall, the container can be joined together again by means of a material different from the base material of the container wall. Preferably the material different from the base material of the container is an adhesive material.

It is also preferable for a weakening or severing to take place in an area of the can body. In an alternative embodiment, the weakening or severing of the can body takes place in am area adjacent to the can lid body.

Preferably, the can body of the container, in the vicinity of the weakening or severing of the container wall, is provided on its inside with a sealing material extending substantially entirely round the can body circumference. In the area of the sealing material, the can body can be provided with at least two substantially horizontally directed corrugations. Preferably, the weakening or severing of the can body takes place between the two corrugations.

According to a preferred embodiment the weakening or severing of the can body takes place on one of the corrugations.

According to an alternative embodiment there are at least three corrugations and the weakening or severing of the can body takes place on the central corrugation.

Preferably, the sealing material extends into the intermediate area between the can body and the lid body.

There can also be a weakening or severing in the area of the lid body. In a further embodiment the weakening or severing of the lid body takes place in the area of a fold of the lid body.

In a further alternative embodiment of the invention, a sealing material is applied substantially completely round the circumference in the area of the weakening or severing of the lid body or on the outside of the fold of the lid body or the outside of the lid body. A suitable plastics material can be used as the sealing material.

The invention also contemplates that the marginal area of the lid body be nondetachably connected to the outside of the circumferential surface of the container can body and that an interengaging thread for opening the container be provided both in the can body and in the lid body to permit reengagement of the lid to the can after opening.

In another embodiment of the invention the interengaging thread is located above the weakening or severing line. The invention also encompasses the interengaging thread being located below the weakening or severing line.

Preferably, the weakening or severing of the container wall takes place by multiple cutting. Alternatively the weakening or severing of the container wall may take place by laser technology.

According to another embodiment, following the weakening or severing of the container wall, a corrosion surface treatment takes place on the cutting face.

The weakening or severing of the container wall can take place on a substantially horizontal, circumferential line or can take place on a wavy, circumferential line.

The invention also encompasses providing the weakening of the connection between the lid and can body take place between the can body and the lid body.

Alternatively a substantially fully circumferential deformation may be provided in the vicinity of the fold formed at the edges of the can body and the lid body.

According to another embodiment of the invention deformation of the container material takes place in such a way that the angle of the plane which runs furthest radially outwardly from the contact face of the can body and lid body is so modified that a separation is possible between the can body and the lid body without the aid of a tool. In another embodiment the plane which is located radially furthest outwardly from the contact face of the can body and lid body, after deformation, is substantially parallel to the can body wall.

In an alternative embodiment a coating at least partly deformable under pressure and, optionally, heat action is provided on the inside of the can body and/or on the inside of the lid body, at least in the area in which the can body and lid body are in contact with one another. The coating may be a polypropylene homopolymer or copolymer.

Preferably, prior to the welding of the filled container to the lid part the container is sealed with a foil of heat-sealable, varnished aluminum, plastic or a corresponding composite material.

The invention also relates to a container, which can be produced according to the process of the invention. Preferably, the container is a can-like pack.

By means of the inventive process, it is possible in a surprisingly simple manner to make available for containers, particularly can-like packs and more especially cans made from metal or the like, an easy open system without requiring special precautionary measures for the sterilization process. This is so because the measures for providing an easy open system take place, according to the invention, only following the sterilization process. It is possible in this way to use sterilization processes which have proved themselves over many decades. Thus, the can body is filled with the intended container content and sterilized at temperatures adequate for preserving the container contents, so that there is no need for expensive retooling of existing production installations for these process steps.

Within the scope of the present invention, the term "lid body" refers to any type of container closure, as a function of the container type, which functions as a closure for the container. In the case of a can, the lid body can be the lid or base.

The weakening or severing of the container, in an alternative embodiment can be a weakening or severing of the metal from which the can is made. In a second alternative the material of the can body may be severed all round in a first step and then the two parts of the container may be joined together again by means of a material differing from the base material, such as a sterilization-resistant adhesive material. This makes it possible to create an area in which the intended weakening or severing of the container wall can be more easily performed as a final step following the sterilization of the sealed can. For the case where the weakening or severing relates to the can body, in order to ensure the success of the inventive process, it is merely necessary to apply a sealing material, e.g. a strip of a corresponding plastics material in the intended area of the inner wall of the can body where the weakening or severing of the can body takes place. This ensures a reliable sterile sealing of the container in that area.

Where the weakening or severing occurs in the lid body no backing of the can body with a sealing material is necessary if the weakening takes place in the vicinity of the fold of the lid and can body. The reliability of the sterile sealing of the pack in this case is ensured by a sealing material introduced between the fold component provided by the can body and the lid body and which, following the weakening or severing of the base material, still remains functional in the vicinity of the lid body fold and ensures a reliable, sterile seal. It is alternatively possible to apply a sealing material, e.g. a strip of a corresponding plastics material for covering the weakening or severing line over the weakening or severing.

This also applies in the case where the lid body is mounted or fixed in overlapping manner on the can body, so that the inside of the lid body is at least partly in contact with the outside of the can body and the marginal area of the lid body is connected, in a non-detachable manner, to the outside, e.g. by soldering.

The weakening or severing of the container wall can take place in a random manner, particularly by a circumferential, mechanical cutting open or the use of laser technology. To prevent corrosion in the cutting area, preferably the area is subject to a final surface corrosion treatment.

In a preferred embodiment of the invention an at least partly deformable, coating of e.g. a copolymer of polypropylene and polyethylene, is provided on the inside of the can body and/or lid body and is compressed on sealing the container with the lid body. Under pressure and heat the coating undergoes deformation and consequently forms a sealing closure of the container interior. This is particularly advantageous on sterilizing the filled sealed can, so as to ensure that during sterilization the can is not made to leak due to the pressure occurring in the interior thereof. It is also possible in this case to make the weakening or severing of the base material deeper or lower, so as to simplify opening of the can.

The inner coating provided in this embodiment also has the advantage of permitting a tighter seal if, following the opening of the can and partial emptying thereof, the lid body is to be resealed on the can.

Similar advantages arise in another embodiment, i.e., on closing the container with a foil, prior to the sealing with the lid body. This leads to a hermetic sealing of the container by use of the foil. The lid body provides the support to withstand the internal pressure occurring on sterilization. Here again it is possible to make the weakening or severing of the container wall lower or deeper so as to permit a subsequent easier opening and resealing of the container.

The position of the weakening or severing of the container wall, as well as the linear guidance of the severing or weakening and the arrangement of the backed, sealing material in the can interior may be varied. These are shown in non-restrictive manner in the following examples and the accompanying drawings.

The weakening or deformations preferably takes place in a substantially completely circumferential manner in the vicinity of the fold between the can body and the lid body. This deformation must take place in such a way that there is still an adequate firm closure between the can body and the lid body. Since the weakening takes place after sterilization the can structure no longer needs the strength to withstand high internal pressures.

This makes it possible to make deformations in the fold area permitting the separation of the lid body and the can body without the aid of a tool and without weakening the connection in such a way that the can will unintentionally open during storage and transportation.

DESCRIPTION OF THE PREFERRED EMBODIMENTS

In all the drawings the can body is designated 10 and the lid flanged onto it 20.

Figure 1:
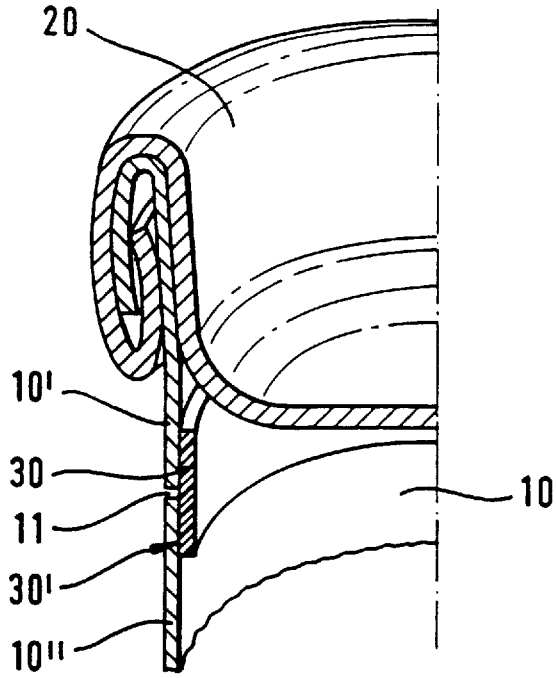
FIGS. 1 to 8 are partial cross-sections of the areas showing the present invention for numerous embodiments of the cans of the present invention.

In a first embodiment (FIG. 1) in the upper area of the can body 10, just below the lid 20, the inner wall of the can body is backed with a circumferential strip 30 of a sealing material, preferably plastic. A weakening or severing of the can body is provided at 11. The weakening can be mechanically provided by a cutting tool or a laser and may be partially through or completely through the can material. The weakening at this point must be sufficient to ensure that during the reciprocal turning of the upper portion 10' of the can body together with the lid 20 against the lower portion 10" of the can body, the upper part can be detached over the entire circumference of the can. With regards to the plastic backing strip 30, there can be a tearing in the vicinity of the weakening or severing line of the can body during this shear movement, particularly if the weakening has been a complete severing as the plastic strip may also be "scratched." Alternatively, the plastic backing strip 30 may be detached at the interface 30' between the can body 10 and the plastic strip 30.

If the separation takes place at the interface 30', this preferably occurs in the area below the weakening or severing line, because in this case the resealability of the opened can is facilitated. For this purpose consideration should be given to fixing the plastic backing strip with a stronger bond in the upper area of the can than in the lower area.

Figure 2:
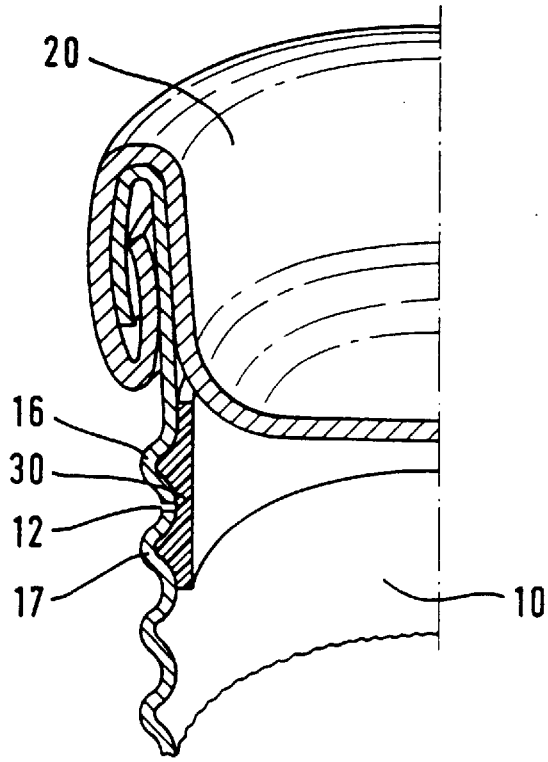

A further embodiment of the invention is shown in FIG. 2. In this embodiment plastic backing strip 30 is provided in the area of two substantially horizontally directed corrugations 16 and 17. The weakening or severing of the can body in this embodiment takes place at a point 12 between the two corrugations. This provides a guidance to the cutting tool for applying the weakening or severing line.

Figure 3:
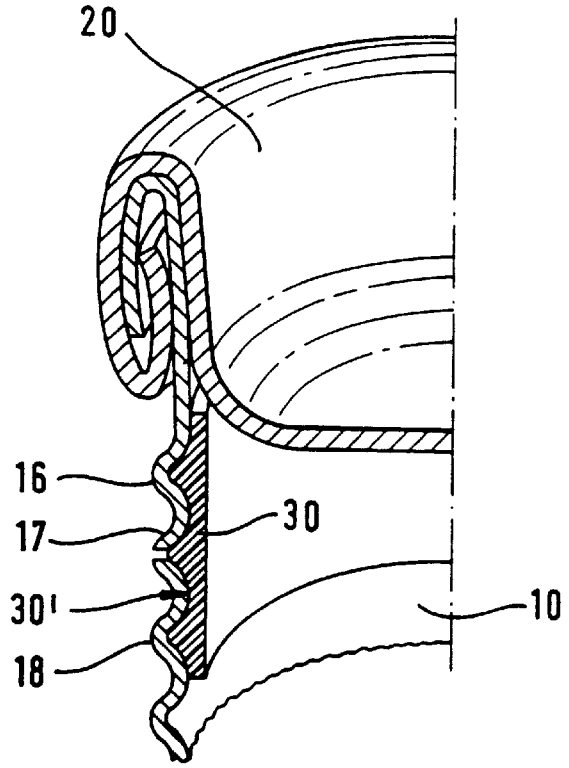

In the embodiment according to FIG. 3 there are in all three substantially equidistant, horizontal corrugations 16, 17, 18 backed with a plastic strip 30. Here the weakening or severing of the can body takes place on the central corrugation 17. Since, in this area the plastic backing material has its greatest thickness, a greater securing is achieved so that on severing the can body the plastic backing material is not severed or so extensively damaged so it may be used to ensure a reliable resealing of the can.

Particularly, in this embodiment it is advantageous if, during the shear movement for opening the can, there is a separation at the interface 30' between the can body 10 and the plastic material 30 in the lower area, i.e. below the weakening or severing line. In this case, as a result of the design of the plastic backing material and the corrugation arrangement, a particularly easy reliable resealing is ensured by simple replacement of the severed top from above and the locking of the plastic strip in the corrugation.

Figure 4:
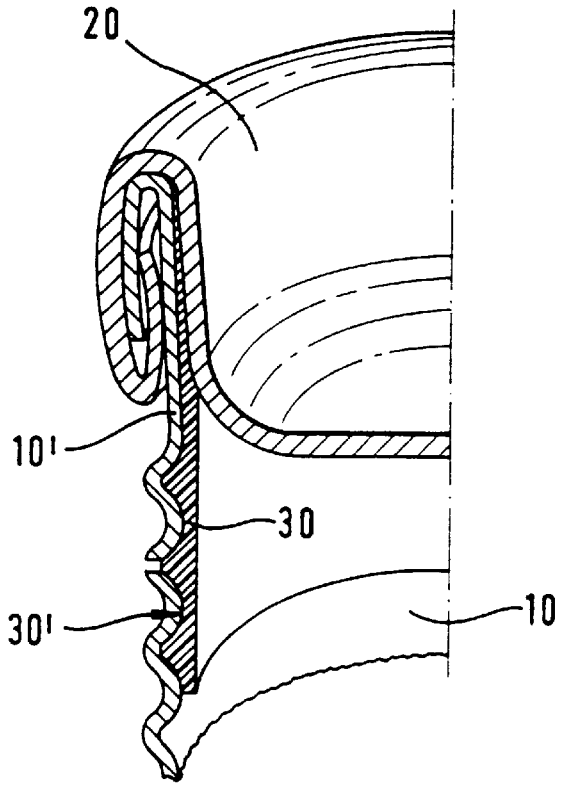

In the variant of FIG. 4 the plastic backing material 30 is additionally drawn up into the can inner wall or down into the lid 20 to such an extent that the plastic material projects into the area between the can body and the lid. This ensures a particularly firm connection of the plastic material in the upper area 10' of the can body and consequently more reliably ensures that a separation takes place at the interface 30' below the weakening or severing line.

In the embodiment according to FIG. 5 the weakening or severing of the can body takes place at 11 below the corrugations 16 and 17 and the plastic material 30 is located on the inside of the can body 10 below the corrugation.

Figure 6:
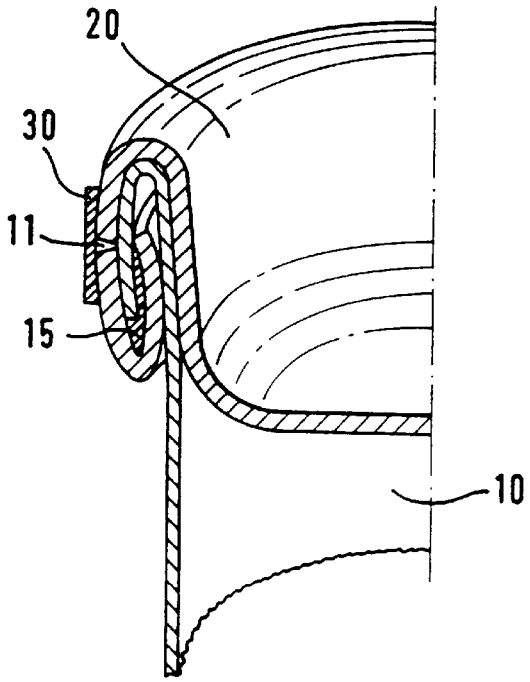

In another embodiment shown in FIG. 6, formation of a fold or seam takes place in the marginal area of the lid 20. The fold includes portions of the edge of lid 20 and the upper end of the can body 10 so that material from both form the fold. Sealing material 15, which may also be plastic, is located between the two components forming the fold. The weakening or severing of the container in this embodiment, takes place in the vicinity of the fold at 11. Here the weakening or severing relating to the fold component is supplied to the lid 20. As a result of the presence of sealing material 15 it is ensured that after carrying out the weakening in the fold area, the can is still tightly sealed until severed by twisting the top off.

Alternatively, in this embodiment the severing or weakening point 11 can be covered with a circumferential strip of plastic material 30.

Figure 7:
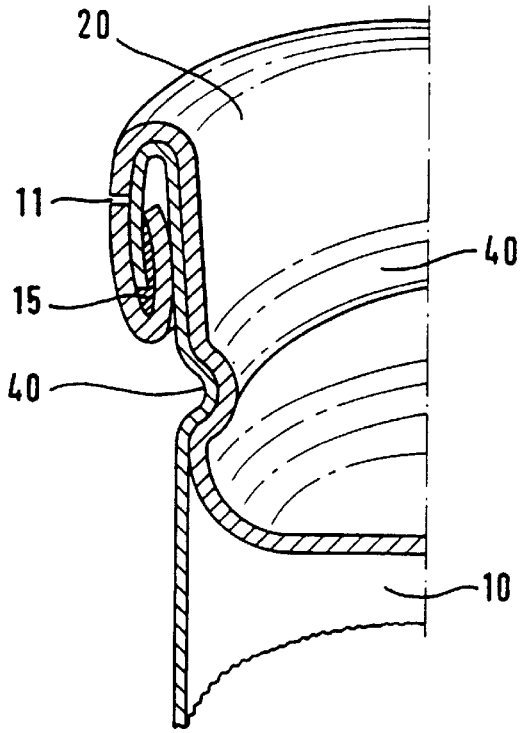

FIG. 7 illustrates another embodiment which has a similar location for the weakening or severing 11 with respect to the can material. In this embodiment the central portion of the top 20 extends further into the open top of can body 10 and mating corrugations or threads 40 are provided in both the can top 20 and can body 10 so that once the top has been severed, to access the can contents, the top can be replaced by mating cooperation of threads 40.

Figure 8:
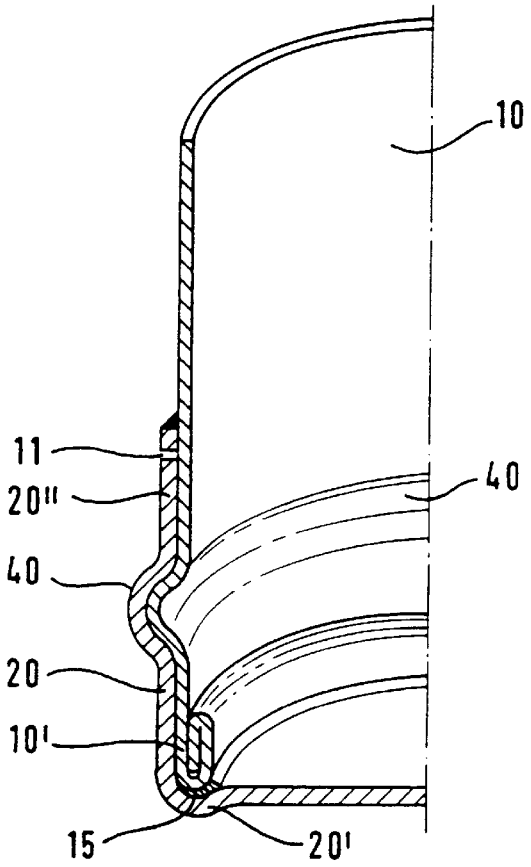

In another embodiment shown in FIG. 8 the lid 20 is shoved over the upper area 10' of the can body and seals the latter. The seat of the lid on the can body, as in the embodiment of FIG. 7, is fixed by threads 40 formed in the lid and can body. A sealing material 15 is located in the contact area between the upper portion 20' of the lid and the upper portion 10' of the can body to ensure the sterilization-proof sealing of the can. The lower area 20" of the lid, and in particular its marginal region, is soldered and consequently non-detachably connected to the can body 10. The weakening or severing point 11 of the can is, in this embodiment, located in the lower area 20" of the lid. As in the embodiment shown in FIG. 7, exterior plastic strip material 30 is not necessary because sealing material 15 ensures the tight seal of the can following the application of the weakening or severing according to the invention.

Figure 5:
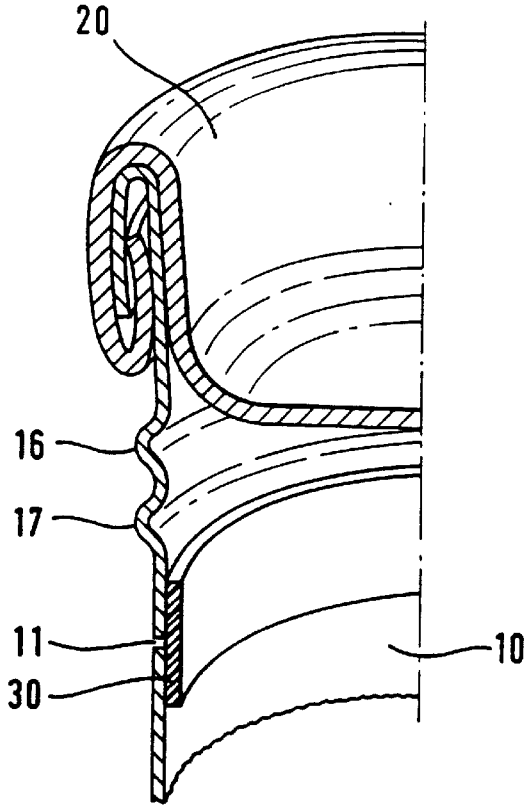
Figure 9:
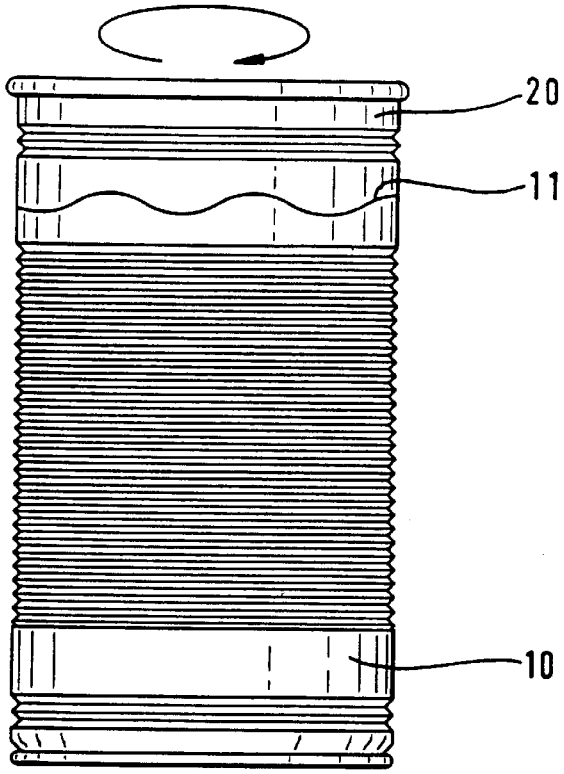
FIG. 9 is a diagrammatic overall view of the can of FIG. 5.

FIG. 9 is a diagrammatic overall view of the embodiment according to FIG. 5 in which the above described, substantially horizontal, circumferential weakening or severing line, is replaced by a wavy line direction, so that over certain areas of the can circumference there is a gradient. With this structure a corresponding lift on opening the can results which reduces the force expenditure for can opening.

Figure 10:
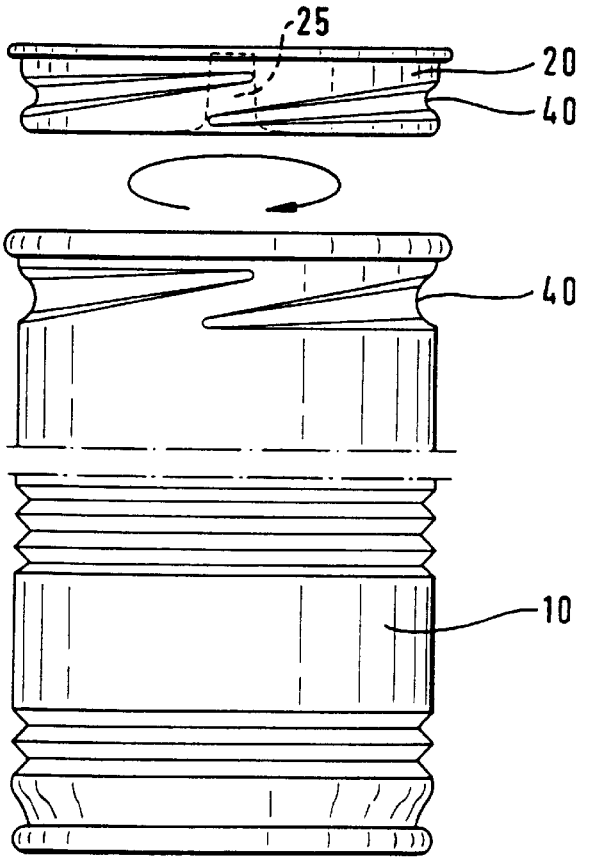
FIG. 10 is a diagrammatic overall view of the can of FIG. 7.

FIG. 10 is a diagrammatic overall view of the embodiment of FIG. 7 comprising the can body 10 and lid 20 with the lid 20 and can body 10 interengaging with a thread form 40. The thread then provides the sealing force necessary for a reliable resealability of the lid to the can. This structure also provides much greater mechanical loading ability to resist internal pressure during the sterilization process as the pressure is absorbed by the fold or seam. As in all the embodiments the weakening is provided after sterilization. To minimize the force expenditure on opening the can a gripping bead 25, preferably in the central area of the lid 20, is provided.

Figure 11:
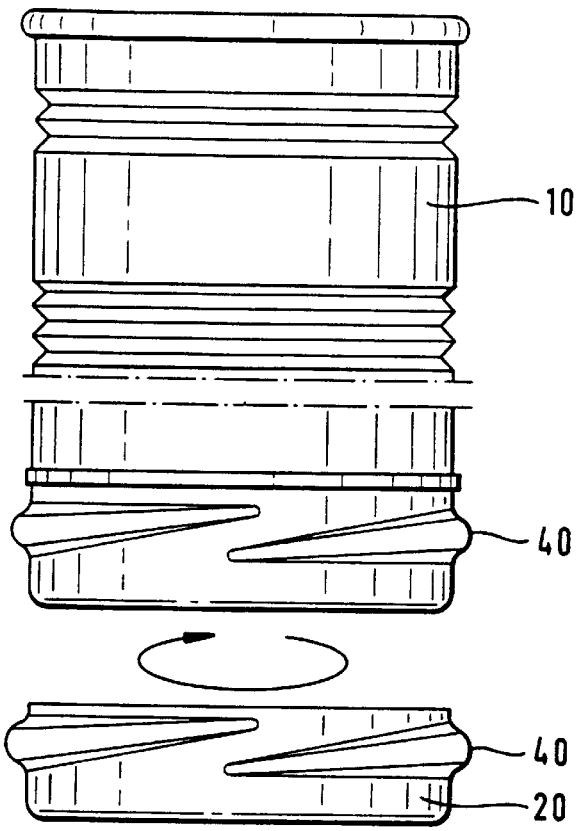
FIG. 11 is a diagrammatic overall view of the can shown in FIG. 8.

FIG. 11 illustrate a diagrammatic overall view of the can shown in FIG. 8 comprising the can body 10 and lid 20. Similar to the concept of FIG. 7, here again a thread form 40 is responsible for absorbing the sealing force. The absorption of the forces occurring during the sterilization process is also ensured here by the marginal area soldered onto the can body 10 in the lower area 20" of the lid. In this embodiment it is obvious to fill the can body 10 at the bottom through the bottom opening of the can body 10. After completing the filling lid 20 is sealed to the can body at the bottom in the conventional way. Only after the pack and its content have been sterilized is a weakening or severing of the base material of the lid 20 brought about in accordance which the invention. The weakening or severing point here is below the lowest point of the thread 40.

Figure 12:
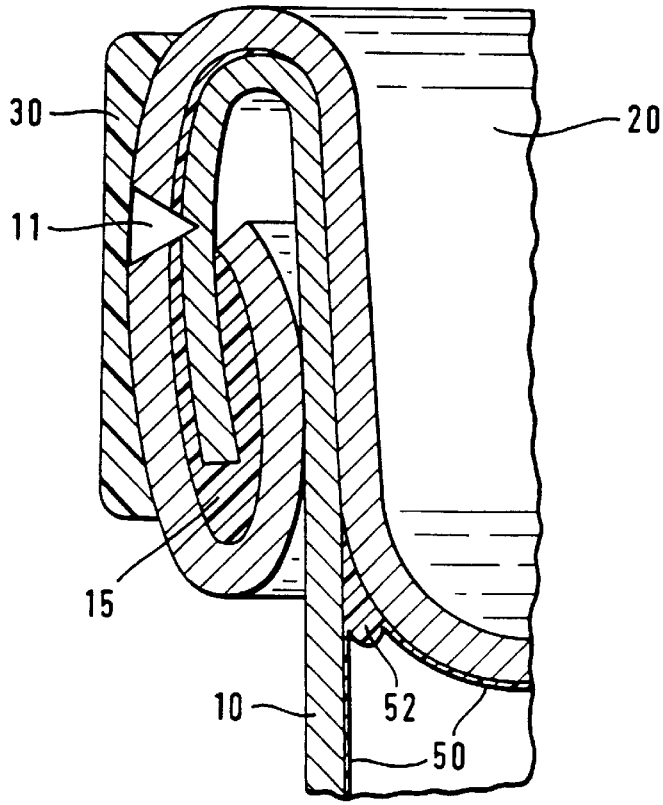
FIG. 12 is a partial sectional view of another preferred embodiment of the invention.

FIG. 12 shows the upper marginal area of a can. In this particular embodiment, which otherwise corresponds to that of FIG. 6, a coating 50 is provided both on the inside of the lid body 20 and on the inside of the can body 10. Coating 50, which preferably consists of a polypropylene homopolymer or copolymer, is compressed on closing the can body by the lid body and is deformed under this pressure and, optionally, additional heat, which leads to formation of a bead 52, so that there is a better sealing in this area. Bead 52 in addition to the external sealing of the weakening or severing by strip 30 and sealing material 15 introduced in the fold area, provides further certainty for a tightly sealed closure of the can.

Figure 13:
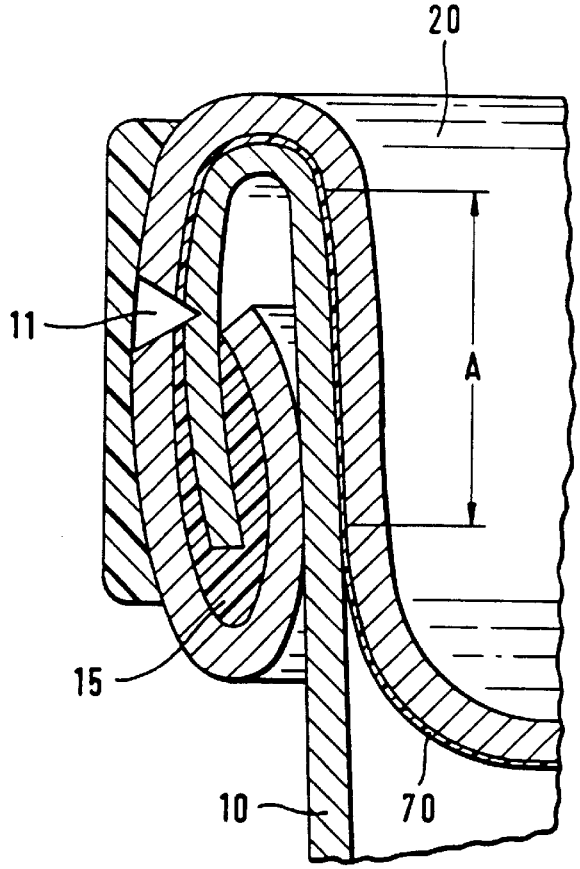
FIG. 13 is a partial sectional view of another embodiment of the invention.

FIG. 13 shows another embodiment in which the can body 10 is sealed with a (sealable) foil 70, e.g. of a composite material of aluminum and plastic, prior to the further closure with the lid body. The closure with the sealable foil takes place through sealing in the marginal area of the can body 10, e.g. on the inside of the can body in the indicated area A.

Figure 14:
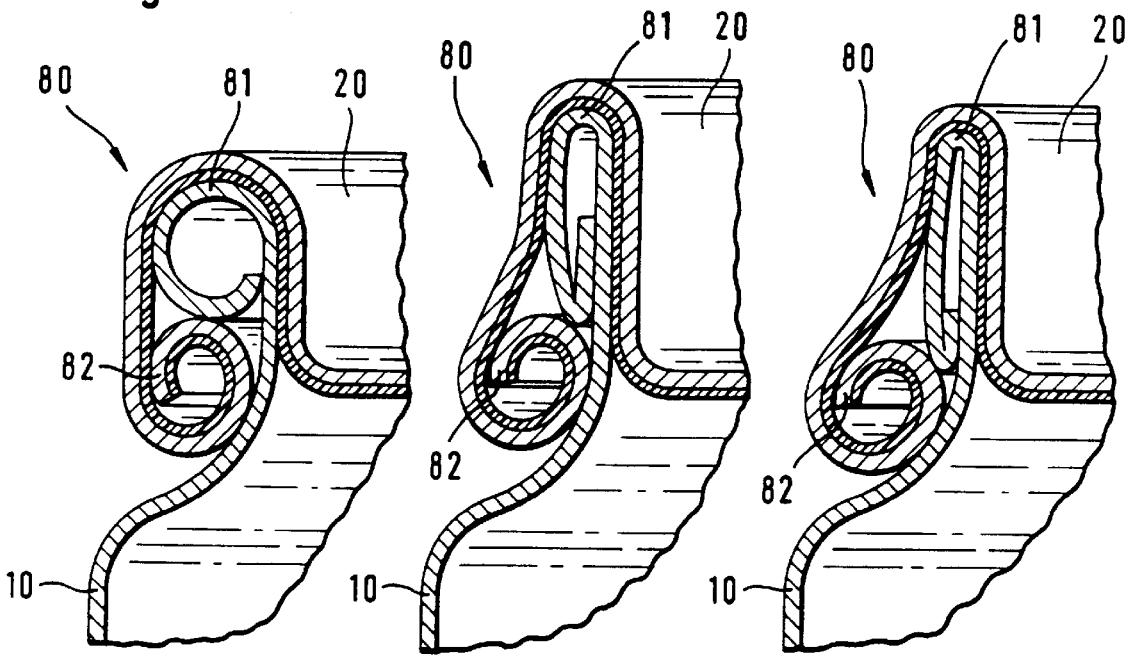
FIG. 14 is a series of partial sectional views showing the fold area of a can prior to the inventive deformation step and two alternatives for a deformation in the fold area.

FIG. 14 shows two different possibilities of a deformation in the fold area 10 of a sterilization-resistant sealed can. The left-hand representation shows the typical fold closure of a can, which is suitable to withstand the internal pressures occurring on sterilization but which does not include the weakening of the present invention so that opening of this can is not possible without the aid of a tool.

According to the invention after sterilization a deformation tool is applied to the upper portion of the fold area in area 80, as shown in two alternatives in the middle and right-hand representation of FIG. 14. The deformation tool presses the upper portion of the fold area 80 inwardly, so that the flanging 81 at the upper edge of the can body 10 is deformed, i.e. pressed flat to a greater extent. This deformation weakens the engagement between the flanging 81 of the can body 10 and the flanging 82 of the lid 20 so that, the can can be opened without the aid of a tool, i.e. by simply screwing open.

The weakening of the connection between the can body 10 and lid 20 is not so great that an unintentional opening of the can need be feared during storage and transportation.

Obviously further, possibilities exist for the deformation in the fold area of the can and which fulfill the same function. It would, for example, be possible for the engagement between the flanging of the can body and the lid for the sterilization step to slope outwards, i.e. the flanging of the can body engages radially outwards over that of the lid and during the subsequent deformation step there can be a sufficient weakening to ensure that the arrangement of the flangings is raised, i.e. the flanging of the can body is located substantially directly over the flanging of the lid. Naturally, in this case, the flangings would have to be made flatter than in the left-hand representation of FIG. 14, so as to permit an easy opening of the can, without the aid of a tool.

The features of the invention disclosed in the description and drawings can be different embodiments, either singly or in the form of random combinations.

What is claimed is:

1. A sealed container which can be opened without the aid of a tool comprising a container body portion and a container lid portion, a weakening provided in said container in a circumferential portion of said container in an area near the juncture of said container body portion and said container lid portion, said container body portion including at least a pair of outwardly extending corrugations and said weakening being provided between said corrugations whereby a twisting force applied between said container lid portion and said container body portion effects separation of said container lid portion from said container body portion.

2. A sealed container according to claim 1 wherein said weakening is a circumferential cut completely through the container material.

3. A sealed container according to claim 1 wherein said weakening is a circumferential cut partially through the container material.

4. A sealed container according to claim 1 including a sealing strip circumferentially disposed about the interior surface of said container behind said weakening.

5. A sealed container according to claim 2 including a sealing strip circumferentially disposed about the interior surface of said container behind said weakening.

6. A sealed container according to claims 4 or 5 wherein said sealing strip is a plastic material and is secured to said container body portion by adhesive in such a manner as to provide a seal after said container is opened and said lid portion is reengaged on said body portion.

7. A sealed container which can be opened without the aid of a tool comprising, a container body portion and a container lid portion, a weakening provided in said container in a circumferential portion of said container in an area near the juncture of said container body portion and said container lid portion whereby a twisting force applied between said container lid portion and said container body portion effects separation of said container lid portion from said container body portion and wherein said container body portion includes at least three outwardly extending corrugations and said weakening is provided on the middle one of said corrugations.

8. A sealed container which can be opened without the aid of a tool comprising, a container body portion and a container lid portion, a weakening provided in said container in a circumferential portion of said container in an area near the juncture of said container body portion and said container lid portion whereby a twisting force applied between said container lid portion and said container body portion effects separation of said container lid portion from said container body portion and wherein said container body portion and said container lid portion each include a complementary corrugation in the form of a thread to permit reengagement of said lid portion to said body portion after said lid portion has been disengaged from said body portion.

* * * * *